United States Patent [19]

Matsunaga

[11] Patent Number: 4,640,241

[45] Date of Patent: Feb. 3, 1987

[54] FUEL INJECTION APPARATUS FOR DIESEL ENGINES

[75] Inventor: Masahiro Matsunaga, Higashimatsuyama, Japan

[73] Assignee: Diesel Kiki Co., Ltd., Japan

[21] Appl. No.: 738,944

[22] Filed: May 29, 1985

[30] Foreign Application Priority Data

May 29, 1984 [JP] Japan ..... 59-107484
May 29, 1984 [JP] Japan ..... 59-107485

[51] Int. Cl.[4] ..... F03M 39/00
[52] U.S. Cl. ..... 123/198 F; 123/357
[58] Field of Search ..... 123/357, 358, 359, 198 F

[56] References Cited

U.S. PATENT DOCUMENTS

| | | | |
|---|---|---|---|
| 3,815,563 | 6/1974 | Stinsa | 123/198 F |
| 3,902,472 | 9/1975 | Baugelin | 123/198 F |
| 4,064,844 | 12/1977 | Matsumoto | 123/198 F |
| 4,144,864 | 3/1979 | Kato | 123/198 F |
| 4,207,856 | 6/1980 | Sugasawa | 123/198 F |
| 4,224,920 | 9/1980 | Sugasawa | 123/198 F |
| 4,263,782 | 4/1981 | Matsumoto | 123/198 F |
| 4,297,929 | 11/1981 | Kamleitner | 123/198 F |
| 4,398,520 | 8/1983 | Schulz | 123/198 F |

*Primary Examiner*—Carl Stuart Miller
*Attorney, Agent, or Firm*—Guy W. Shoup

[57] ABSTRACT

In a fuel injection apparatus for multi-cylinder engines, the apparatus has a signal generator for generating an electric signal representing an operating condition of the engine, a decision circuit for determining the cylinder or cylinders of the engine to be used in accordance with the electric signal, a control device which is responsive to the output of the decision circuit and selects the cylinder or cylinders of the engine to which fuel injected from a fuel injection pump is to be supplied, and a control circuit for regulating the control of the amount of fuel injection from the fuel injection pump on the basis of a governor characteristic determined in accordance with the output of the decision circuit, whereby the engine can be operated in the skip-cylinder mode more stably than in the case of the conventional apparatus.

12 Claims, 4 Drawing Figures

FUEL INJECTION APPARATUS FOR DIESEL ENGINES

BACKGROUND OF THE INVENTION

The present invention relates to a fuel injection apparatus for diesel engines, which is capable of assuring stable operation of a diesel engine even when the diesel engine is operated in a skip-cylinder mode.

In the prior art, in order to control the output from a multi-cylinder diesel engine, the diesel engine is often operated in so-called skip-cylinder mode in which fuel is supplied from a fuel injection pump to only particular cylinders selected in accordance with the operating condition of the engine. As disclosed in, for example, Japanese Patent Application Disclosure Nos. Sho 56-106,055 and Sho 57-38,629, the skip-cylinder operation of an engine is carried out by selectively cutting off the fuel supply to one or more cylinders selected in accordance with the operating condition of the engine.

However, since the operating condition of the engine changes when it is changed to skip-cylinder mode, various disadvantages arise. For example, when skip-cylinder operation is carried out so as to supply fuel to half of the cylinders of the engine, the change in output torque increases and the period thereof becomes double. Furthermore, the time period between the time the adjustment of the position of the member for adjusting the amount of fuel injection is carried out and the time the injected fuel starts to burn also becomes double, so that the control delay time becomes double. As a result, in skip-cylinder mode of engine operation, hunting is liable to occur and engine vibration is apt to increase, so that it becomes difficult to operate the engine stably.

SUMMARY OF THE INVENTION

It is therefore an object of the present invention to provide an improved fuel injection apparatus for diesel engines which is suitable for an engine selectively operated in either skip-cylinder or non-skip-cylinder (normal) mode.

It is another object of the present invention to provide a fuel injection apparatus for diesel engines which can assure stable operation of the diesel engine even when the diesel engine is operated in skip-cylinder mode.

In accordance with the present invention, in a fuel injection apparatus for multi-cylinder engines, the apparatus comprises a fuel injection pump having a fuel regulating member, a first means for producing at least one electric signal which represents an operating condition of the diesel engine, a second means responsive to at least the electric signal for determining the cylinder or cylinders of the diesel engine to be used, a control device which is responsive to the result of the determination in the second means and selects the cylinder or cylinders of the diesel engine to which fuel injected from a fuel injection pump is to be supplied, and a third means responsive to at least the electric signal for regulating the control of the amount of fuel injection from the fuel injection pump on the basis of a governor characteristic determined in accordance with the result of the determination in the second means.

With this structure, since the governor characteristic of the fuel injection pump can be determined on the basis of the operating condition of the control device, the regulation of the amount of fuel injected from the fuel injection pump can be carried out in accordance with a governor characteristic suitable for skip-cylinder mode operation when the diesel engine is operated in skip-cylinder mode. As a result, the diesel engine can be operated in the skip-cylinder mode more stably than in the case of the conventional apparatus.

Furthermore, in a preferred embodiment, speed data showing the average speed of the diesel engine is also separately calculated for operation in non-skip-cylinder mode and operation in skip-cylinder mode. In this case, the fuel adjusting operation in the third means is carried out by the use of speed data corresponding to the selected engine operation mode. As a result, extremely stable operation of the engine in skip-cylinder mode can be realized.

The present invention will be better understood and the other objects and advantages thereof will be more apparent from the following detailed description of preferred embodiments with reference to the accompanying drawings.

DETAILED DESCRIPTION OF THE INVENTION

Figure 1:
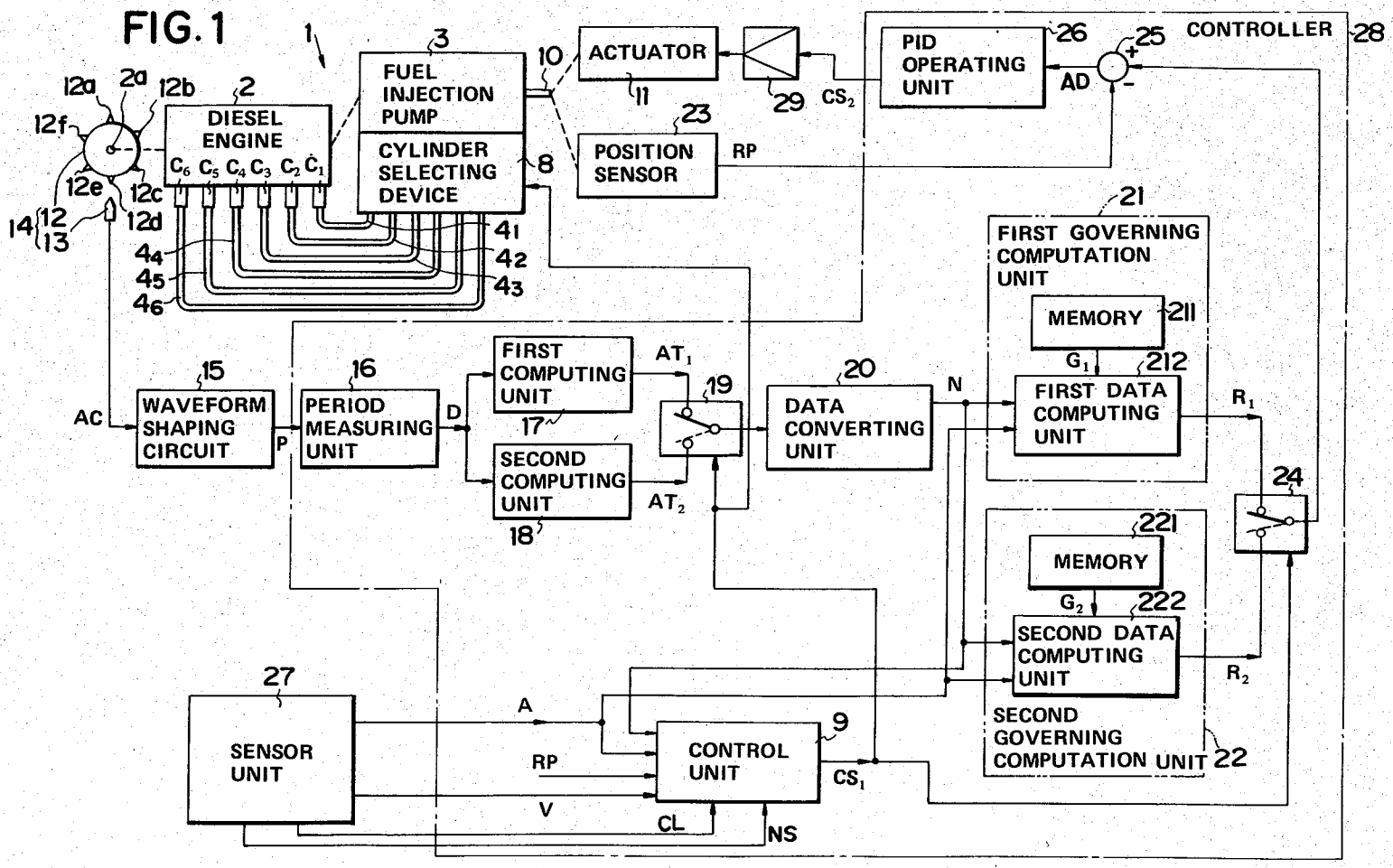
FIG. 1 is a block diagram of an embodiment of a fuel injection apparatus according to the present invention shown together with the other components of the diesel engine system in which it is applied.

FIG. 1 shows a block diagram of an embodiment of a fuel injection apparatus according to the present invention. A diesel engine system 1 has a fuel injection pump 3 for supplying fuel to a multi-cylinder diesel engine 2 and the fuel from the fuel injection pump 3 is supplied to the cylinders of the diesel engine 2 through respective injection pipes. In the embodiment shown in FIG. 1, the diesel engine 2 is a 4-cycle 6-cylinder engine, so that fuel is supplied to six cylinders $C_1$ to $C_6$ via six injection pipes $4_1$ to $4_6$. In this embodiment, the diesel engine system 1 is used for driving a vehicle (not shown) and the rotating output power from the diesel engine 2 is transmitted through a clutch and a transmission to driving wheels (none of which are shown).

In order to make it possible to realize skip-cylinder operation of the diesel engine 2 if desired, a cylinder selecting device 8 is mounted on the fuel injection pump 3. The cylinder selecting device 8 is for cutting off the fuel supply to any desired cylinder or cylinders, whereby it is possible to operate the diesel engine 2 in the normal condition with six cylinders or in the skip-cylinder condition using a desired number of cylinders less than six. The cylinder selecting device 8 may include solenoid valves and operates in response to a control signal $CS_1$ supplied from a control unit 9 which will be described in more detail hereinafter. In this embodiment, in skip-cylinder operation of the diesel engine 2, fuel is supplied to the three cylinders $C_1$, $C_3$ and $C_5$ among the six cylinders of the diesel engine 2. However, the cylinders used during skip-cylinder operation are not limited to those of this embodiment.

A control rack 10 of the fuel injection pump 3 is connected to an actuator 11 for positioning the control rack 10. The actuator 11 is driven by a control signal $CS_2$ from a controller 28 taking account of whether or not the diesel engine 2 is in skip-cylinder operation.

Figure 2:
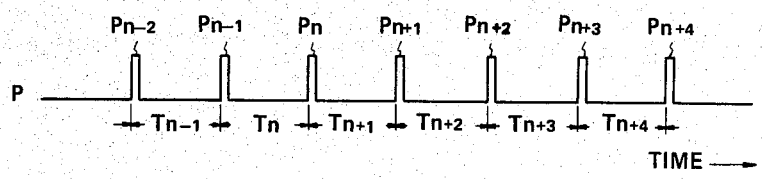
FIG. 2 is diagram showing a pulse signal output by a waveform shaping circuit in FIG. 1.

To detect the speed of the diesel engine 2 at each instant, there is provided a speed sensor 14 which is composed of a pulser 12 secured on an output shaft $2_a$ of the diesel engine 2 and an electromagnetic pick-up coil 13 located adjacent to the pulser 12. Cogs $12_a$ to $12_f$ are provided on the outer periphery of the pulser 12 at angular intervals of 60°. As each cog approaches toward and departs from the electromagnetic pick-up coil 13, an a.c. signal AC is produced from the electromagnetic pick-up coil 13. The signals AC are shaped by a waveform shaping circuit 15 to produce a pulse signal P as shown in FIG. 2.

The pulse signal P is input to a period measuring unit 16 in the controller 28. Here the periods $T_{n-1}$, $T_n$, $T_{n+1}$, $T_{n+2}$, . . . between adjacent pulses of the pulse signal P are measured as the pulses $P_{n-1}$, $P_n$, $P_{n+1}$, . . . forming the pulse signal P are received, and period data D indicating the period of the pulse signal P at each instant is output. The period data D is applied to a first computing unit 17 for computing the average rotational period $AT_1$ of the diesel engine 2 when the diesel engine 2 is normally operated in non-skip-cylinder mode, that is, as a six cylinder engine, and is applied to a second computing unit 18 for computing the average rotational period $AT_2$ of the diesel engine 2 when the diesel engine 2 is operated in skip-cylinder mode, that is, as a 3-cylinder diesel engine.

In order to obtain the average rotational period for normal operation of the diesel engine 2 in the first computing unit 17, a calculation according to the following formula is carried out therein:

$$AT_{1n} = \frac{T_n + T_{n-1}}{2} \quad (1)$$

Wherein, $AT_{1n}$ is the average rotating period at the time of the occurrence of the pulse $P_n$, $T_n$ is the time from the generation of the pulse $P_{n-1}$ to the generation of the pulse $P_n$, and $T_{n-1}$ is the time from the generation of the pulse $P_{n-2}$ to the generation of the pulse $P_{n-1}$. As will be understood from the foregoing description, the average rotational period shown by the formula (1) is based on the instantaneous engine speed change cycle which occurs because the combustion is carried out in any given cylinder of the diesel engine 2 once every two pulses of the pulse signal P.

On the other hand, in order to calculate the average rotational period of the diesel engine 2 when the diesel engine 2 is operated in skip-cylinder mode, a calculation according to the following formula is carried out in the second computing unit 18:

$$AT_{2n} = \frac{T_n + T_{n-1} + T_{n-2} + T_{n-3}}{4} \quad (2)$$

Where, $AT_{2n}$ is the average rotational period at the time of the generation of the pulse $P_n$, $T_{n-3}$ is the time from the generation of the pulse $P_{n-4}$ to the generation of the pulse $P_{n-3}$, and $T_{n-2}$ is the time from the generation of the pulse $P_{n-3}$ to the generation of the pulse $P_{n-2}$. $T_{n-1}$ and $T_n$ are the same as defined in the formula (1). In this embodiment, since the number of operating cylinders is reduced to one half in skip-cylinder mode, the combustion in the diesel engine 2 is carried out in each of these three cylinders once every four pulses of the pulse signal P. Consequently, it follows that the average rotational period obtained in accordance with the formula (2) is based on the instantaneous engine speed change cycle in skip-cylinder mode.

As a result, a first period data $AT_1$ representing the average rotational period calculated on the basis of the instantaneous speed change cycle of diesel engine 2 in the non-skip-cylinder mode is produced from the first computing unit 17 when the diesel engine 2 operates in normal mode, that is, non-skip-cylinder mode. On the other hand, a second period data $AT_2$ representing the average rotational period calculated on the basis of the instantaneous speed change cycle of the diesel engine 2 in the skip-cylinder mode is produced from the second computing unit 18 when the diesel engine 2 operates in the skip-cylinder mode.

The first and second period data $AT_1$ and $AT_2$ are applied to a selecting switch 19 which operates in response to the control signal $CS_1$ from the control unit 9 to select and derive either period data $AT_1$ or $AT_2$. When the diesel engine 2 operates in non-skip-cylinder mode, the selecting switch 19 is switched over as shown by a solid line in response to the control signal $CS_1$, so that the first period data $AT_1$ is selected. When the diesel engine 2 operates in skip cylinder mode, the selecting switch 19 is switched over as shown by a broken line in response to the control signal $CS_1$, so that the second period data $AT_2$ is selected.

The data selected by the selecting switch 19 is input to a data converting unit 20 in which the input period data is converted into a speed data N representing the speed of the diesel engine 2. The speed data N is input to the control unit 9, a first governing computation unit 21 and a second governing computation unit 22.

The first governing computation unit 21 has a memory 211 in which data $G_1$ representing the governor characteristic appropriate for normal operation (non-skip-cylinder mode) of the diesel engine 2 is stored and a first data computing unit 212. The speed data N and an acceleration data A which is output from a sensor unit 27 and indicates the amount of the operation of the accelerator pedal (not shown) are applied to the first data computing unit 212, from which a first target data $R_1$ is produced in response to the data N and A on the basis of the data $G_1$ from the memory 211. The first target data $R_1$ represents the target position of the control rack 10 enabling the optimum amount of fuel injection for operating the diesel engine 2 at each instant. An example of the governor characteristic represented by data $G_1$ is shown by the solid line in FIG. 4.

The second governing computation unit 22 has a memory 221 in which data $G_2$ representing the governor characteristic appropriate for skip-cylinder mode operation of the diesel engine 2 is stored and a second data computing unit 222. The speed data N and the acceleration data A are applied to the second data computing unit 222, from which a second target data $R_2$ is produced in response to the data N and A on the basis of the data $G_2$ from the memory 221. The second target data $R_2$ represents the target position of the control rack 10 enabling the optimum amount of fuel injection for the operating condition of the diesel engine 2 at each instant. An example of the governor characteristic represented by data $G_2$ is shown by the broken line in FIG. 4.

Figure 4:
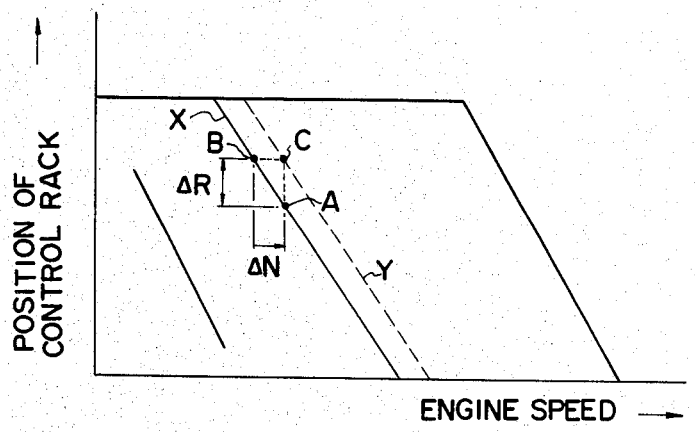
FIG. 4 is a characteristic curve showing an example of governor characteristics represented by data $G_1$ and $G_2$.

In the example shown in FIG. 4, when the operating mode is changed from non-skip-cylinder mode to skip-cylinder mode in the case where the engine operates at an operating point A on the characteristic curve X, since the total amount of fuel injected per one revolution of the engine becomes a half, the operating point of the engine moves to the point B on the characteristic curve X. As a result, if the governor characteristic curve is not changed, the engine speed decreases by ΔN. However, in the apparatus shown in FIG. 1, the governor characteristic curve is changed from the curve X to the curve Y shown by the broken line when the engine operation is changed from the non-skip-cylinder mode to skip-cylinder mode, so that the operating point of the engine moves to the point C on the characteristic curve Y. Consequently, even when the amount of the operation of the accelerator pedal is maintained at a predetermined position, since the position of the control rack 10 increase by ΔR, the engine speed does not change even when the engine operation is changed from the non-skip-cylinder mode to skip-cylinder mode.

To the control unit 9, are applied the speed data N, the acceleration data A, a vehicle speed data V output from the sensor unit 27 and indicating the speed of the vehicle driven by the diesel engine 2, and a position data RP indicating the actual position of the control rack 10. The position data RP is produced from a position sensor 23 connected with the control rack 10. A clutch signal CL showing the ON/OFF state of the clutch and a neutral signal showing that the transmission is in neutral position are also produced from the sensor unit 27 and are applied to the control unit 9. The decision as to whether or not the diesel engine 2 should be operated in skip-cylinder mode is made in the control unit 9 in accordance with these input data and signals. The signal indicating the decision made in the control unit 9 is produced as the control signal $CS_1$, which is supplied to the cylinder selecting device 8, the selecting switch 19 and another selecting switch 24 to which the first and second target data $R_1$ and $R_2$ are input. The selecting switch 24 operates in response to the control signal $CS_1$ so as to be switched over as shown by the solid line when the diesel engine 2 is operated in normal state to select the first target data $R_1$ and so as to be switched over as shown by the broken line when the diesel engine 2 is operated in skip-cylinder mode to select the second target data $R_2$.

The data selected by the selecting switch 24 is applied to an adding unit 25 in which the selected data from the selecting switch 24 is added to the position data RP in accordance with the sign shown in FIG. 1. The resulting data AD from the adding unit 25 is input to a PID operating unit 26 wherein the data AD is subjected to necessary data processing for PID control operation, and the output from the PID operating unit 26 is derived as a control signal $CS_2$. The control signal $CS_2$ is applied through a power amplifier 29 to the actuator 11, whereby the positioning control of the control rack 10 is carried out in closed-loop control mode in accordance with the target data selected by the selecting switch 24.

The operation of the engine system shown in FIG. 1 will now be described.

When the decision that the diesel engine 2 should be operated in the normal mode is made in the control unit 9, the cylinder selecting device 8 selects all of the cylinders of the diesel engine 2 as those to be supplied with fuel. Consequently, the fuel injected from the fuel injection pump 3 is supplied through the injection pipes $4_1$ to $4_6$ to the six cylinders $C_1$ to $C_6$ of the diesel engine 2.

In this case, the selecting switches 19 and 24 are switched over as shown by the solid lines by the control signal $CS_1$. Therefore, the speed data N based on the first period data $AT_1$ from the first computing unit 17 is produced from the data converting unit 20 and applied to the first governing computation unit 21. Thus, the first target data $R_1$ is produced from the first governing computation unit 21 on the basis of the governor characteristic shown by data $G_1$ which is appropriate for normal mode operation of the diesel engine 2 in accordance with the data N and A, whereby the actuator 11 is driven so as to position the control rack 10 at the position indicated by data $R_1$.

When the decision that the diesel engine 2 should be operated in skip-cylinder mode is made in the control unit 9, the cylinder selecting device 8 selects a predetermined three cylinders $C_1$, $C_3$ and $C_5$ of the diesel engine 2 as those to be supplied with fuel. Consequently, the fuel injected from the fuel injection pump 3 is supplied through the injection pipes $4_1$, $4_3$ and $4_5$ to the cylinders $C_1$, $C_3$ and $C_5$ of the diesel engine 2.

In this case, the selecting switches 19 and 24 are switched over as shown by the broken lines by the control signal $CS_1$. Therefore, the speed data N based on the second period data $AT_2$ from the second computing unit 18 is produced from the data converting unit 20 and applied to the second governing computation unit 22. Thus, the second target data $R_2$ is produced from the second governing computation unit 22 on the basis of the governor characteristic shown by data $G_2$ which is appropriate for skip-cylinder mode operation of the diesel engine 2 in accordance with the data N and A, whereby the actuator 11 is driven so as to position the control rack 10 at the position indicated by data $R_2$.

As described above, in this engine system, since there is provided the first computing unit 17 for obtaining the average engine speed during normal operation of the diesel engine 2 and the second computing unit 18 for obtaining the average engine speed during skip-cylinder operation of the diesel engine 2, the average engine speed can always be obtained on the basis of the instantaneous speed change cycle of the diesel engine 2 at each instant regardless of whether the diesel engine is operating in skip-cylinder mode or non-skip-cylinder mode. Since the target data $R_1$ and $R_2$ are computed on the basis of more accurate average engine speeds obtained as described above, it becomes possible to reduce the change in engine torque, hunting and vibration of the engine which ordinarily occur in the skip-cylinder mode, so that smooth operation of the diesel engine 2 in the skip-cylinder mode can be assured.

Since separate governor characteristics are provided for normal operation and skip-cylinder operation of the diesel engine 2, it is possible to carry out the appropriate governing operation for skip-cylinder operation. As a result, more stable operation of the diesel engine in the skip-cylinder mode can be realized as compared with the case where only the average engine speed is separately calculated for non-skip-cylinder operation and skip-cylinder operation.

However, in the case where separate governor characteristics corresponding to the non-skip-cylinder mode and the skip-cylinder mode of the diesel engine 2 are provided, it is not necessarily required to compute both the first and second period data. That is, even when the speed data N based on only the first period data $AT_1$ is used for both the non-skip-cylinder and skip-cylinder modes in this embodiment, the diesel engine 2 can still be stably operated in the skip-cylinder mode because of the provision of the governor characteristic for the skip-cylinder mode.

Figure 3:
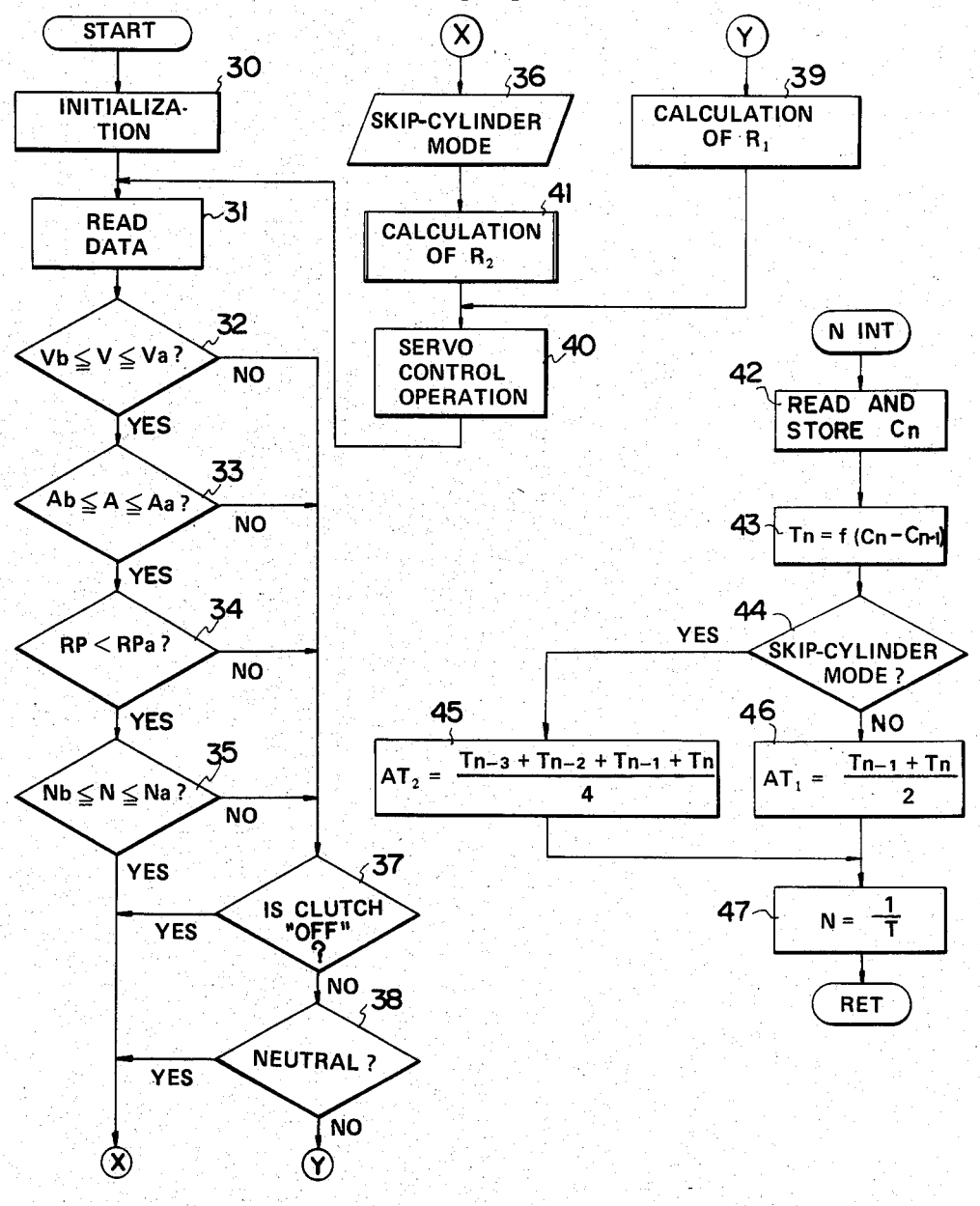
FIG. 3 is a flowchart showing a control program executed by a microcomputer for realizing a function equivalent to a controller in FIG. 1.

The controller 28 may be constituted by the use of a microcomputer. FIG. 3 is a flowchart showing a control program which is executed in the microcomputer for realizing a function equivalent to that of the controller 28.

Referring to FIG. 3, when the execution of the control program is started, at first, the initialization is carried out in step 30 and then the data A, RP and V are read in step 31. After this, decisions are made as to whether the vehicle speed indicated by data V is within a predetermined speed range defined by upper limit $V_a$ and lower limit $V_b$, whether the amount of the operation of the accelerator pedal indicated by the data A is within a predetermined range defined by upper limit $A_a$ and lower limit $A_b$, and whether the position of the control rack indicated by data RP is less than a predetermined position $RP_a$ in steps 32, 33 and 34, respectively. Furthermore, a decision is made in step 35 as to whether the engine speed indicated by speed data N, which is obtained by an interruption program to be described hereinafter, is within a predetermined range defined by upper limit $N_a$ and lower limit $N_b$.

The calculation of the speed of the diesel engine 2 is carried out by the execution of the interrupt program N INT at each occurrence of a pulse of the pulse signal P. At first, the counted value $C_n$ of a free running counter, which is formed in the microcomputer, is read and stored in step 42, and the period $T_n$ of the pulse signal P is computed on the basis of the value $C_n$ and the value $C_{n-1}$ for the preceding time in step 43. Next, a decision is made in step 44 as to whether the diesel engine is in skip-cylinder mode. The determination in step 44 is "YES" when the diesel engine 2 is operated in skip-cylinder mode, in which case the operation moves to step 45 wherein data $AT_2$ is calculated on the basis of the formula (2). The determination in step 44 is "NO" when the diesel engine 2 is operated in non-skip-cylinder mode, in which case the operation moves to step 46 wherein data $AT_1$ is calculated on the basis of the formula (1). After this, the speed data N indicating the speed of the diesel engine 2 is calculated in step 47 in accordance with the relevant average rotational period, and the operation returns to the main program.

If all of the decisions in steps 32 to 35 are "YES", the operation of the diesel engine 2 is put into the skip-cylinder mode in step 36. This operation is carried out by the production of the control signal $CS_1$.

On the other hand, when at least one result in steps 32 to 35 is "NO", the operation moves to step 37 wherein a decision is made as to whether the clutch is OFF. The operation moves to step 36 when the determination in step 37 is YES, while the operation moves to step 38 when the determination in step 37 is NO. In step 38, a decision is made as to whether the gear position of the transmission is neutral. The operation moves to step 36 when the result in step 38 is "YES", while the operation moves to step 39 when the result in step 38 is "NO". In step 39, the calculation for obtaining the first target data $R_1$ is carried out on the basis of the governor data $G_1$ read out from a memory in accordance with data N and A. On the other hand, when skip-cylinder operation of the diesel engine is carried out by step 36, the calculation for obtaining the second target data $R_2$ is carried out in step 41 on the basis of the governor data $G_2$ read out from the memory in accordance with data N and A.

In either mode, after the desired target data representing the target position of the control rack 10 is obtained in step 39 or 41, the operation moves to step 40 wherein a servo control operation for positioning of the control rack 10 in accordance with the target data $R_1$ or $R_2$ is carried out, and then, the operation moves to step 31.

I claim:

1. A fuel injection apparatus for a multi-cylinder diesel engine, comprising:

a fuel injection pump having a fuel regulating member;

a first means for producing at least one electric signal which represents an operating condition of the diesel engine;

a second means responsive to at least the electric signal for determining the cylinder of cylinders of the diesel engine to be used;

a control device which is responsive to the result of the determination in said second means and in accordance with the result of the determination in said second means controls the fuel supply so as to supply fuel to all of the cylinders in a non-skip-cylinder mode operation or to only selected cylinders in a skip-cylinder mode operation; and a third means responsive to at least the electric signal for regulating the amount of fuel injected said fuel injection pump on the basis of a governor characteristic determined in accordance with the result of the determination in said second means, wherein said third means has:

a memory for storing at least first characteristic data representing a governor characteristic for non-skip-cylinder operation of the diesel engine and second characteristic data representing a governor characteristic for skip-cylinder operation of the diesel engine;

a data generating means responsive to the electric signal for generating a target signal representing a target position of the fuel regulating member necessary for obtaining the optimum amount of fuel injection corresponding to the operating condition of the diesel engine at each instant on the basis of the data read out from said memory in accordance with the result of the determination in said second means; and a servo means responsive to the target signal for controlling the position of the fuel regulating member so as to position the fuel regulating member at the position indicated by the target signal.

2. A fuel injection apparatus for a multi-cylinder diesel engine, comprising:

a fuel injection pump having a fuel regulating member;

a first means for producing at least one electric signal which represents an operating condition of the diesel engine;

a second means responsive to at least the electric signal for determining the cylinder or cylinders of the diesel engine to be used;

a control device which is responsive to the result of the determination in said second means and in accordance with the result of the determination in said second means controls the fuel supply so as to supply fuel to all of the cylinders in a non-skip-cylinder mode operation or to only selected cylinders in a skip-cylinder mode operation; and a third means responsive to at least the electric signal for regulating the amount of fuel injected from said fuel injection pump on the basis of a governor characteristic determined in accordance with the result of the determination in said second means, wherein said first means includes means for producing a first data showing the speed of the diesel engine, wherein said producing means has a pulse signal whose period changes in relation to the rotational speed of the diesel engine, a measuring means for measuring the period of the pulse signal, and a converting means for obtaining said first data on the basis of the output of said measuring means, and wherein said measuring means has a first computing unit responsive to the pulse signal for computing a first period data showing the average rotating period of the diesel engine in non-skip-cylinder mode operation on the basis of the instantaneous speed change cycle of the diesel engine in the non-skip-cylinder mode.

3. An apparatus as claimed in claim 1 wherein said first means includes means for producing a first data showing the speed of the diesel engine.

4. An apparatus as claimed in claim 1 wherein said first means further includes means for producing a second data showing the amount of operation of an accelerator pedal.

5. An apparatus as claimed in claim 1 wherein said producing means has a pulse signal generator which generates a pulse signal whose period changes in relation to the rotational speed of the diesel engine, a measuring means for measuring the period of the pulse signal, and a converting means for obtaining said first data on the basis of the output of said measuring means.

6. An apparatus as claimed in claim 2 wherein said measuring means further comprises a second computing unit responsive to the pulse signal for computing a second period data showing the average rotating period of the diesel engine in skip-cylinder mode operation on the basis of the instantaneous speed change cycle of the diesel engine in the skip-cylinder mode, and means responsive to the result of the determination in said second means for selectively outputting either said first or second period data to said converting means.

7. An apparatus as claimed in claim 1 wherein said data generating means has a first data generating means for generating a first target signal in response to said electric signal on the basis of the first characteristic data, a second data generating means for generating a second target signal in response to said electric signal on the basis of the second characteristic data, and a selecting means for selecting either the first or second target signal as the target signal in response to the result of the determination in said second means.

8. An apparatus as claimed in claim 1 wherein said servo means has a position sensor for producing a position signal indicating the actual position of the fuel regulating member and a control unit responsive to the position signal and the target signal for controlling the position of the fuel regulating member so as to reduce the difference between the positions indicated by the target signal and the position signal.

9. An apparatus as claimed in claim 7 wherein said first means includes means for producing a speed data showing the speed of the diesel engine and the speed data is applied to at least said first and second data generating means.

10. An apparatus as claimed in claim 9 wherein said producing means has a pulse signal generator which generates a pulse signal whose period changes in relation to the rotational speed of the diesel engine, a measuring means for measuring the period of the pulse signal, and a converting means for obtaining said first data on the basis of the result of said measuring means.

11. An apparatus as claimed in claim 10 wherein said measuring means has a first computing unit responsive to the pulse signal for computing a first period data showing the average rotating period of the diesel engine in the non-skip-cylinder mode operation on the basis of the instantaneous speed change cycle of the diesel engine in the non-skip-cylinder mode.

12. An apparatus as claimed in claim 11 wherein said measuring means further comprises a second computing unit responsive to the pulse signal for computing a second period data showing the average rotating period of the diesel engine in skip-cylinder mode operation on the basis of the instantaneous speed change cycle of the diesel engine in the skip-cylinder mode, and means responsive to the result of the determination in said second means for selectively outputting either said first or second period data to said converting means.

* * * * *